US009592598B2

(12) United States Patent
Moore

(10) Patent No.: US 9,592,598 B2
(45) Date of Patent: Mar. 14, 2017

(54) HYDRAULIC HAMMER HAVING IMPACT SYSTEM SUBASSEMBLY

(71) Applicant: CATERPILLAR INC., Peoria, IL (US)

(72) Inventor: Cody Moore, Waco, TX (US)

(73) Assignee: Caterpillar Inc., Peoria, IL (US)

( * ) Notice: Subject to any disclaimer, the term of this patent is extended or adjusted under 35 U.S.C. 154(b) by 959 days.

(21) Appl. No.: 13/839,311

(22) Filed: Mar. 15, 2013

(65) Prior Publication Data

US 2014/0262407 A1 Sep. 18, 2014

(51) Int. Cl.

| | |
|---|---|
| ***B25D 9/14*** | (2006.01) |
| ***B25D 9/04*** | (2006.01) |
| ***B25D 9/12*** | (2006.01) |
| ***B25D 9/18*** | (2006.01) |
| ***B25D 9/20*** | (2006.01) |
| ***E02F 3/96*** | (2006.01) |

(52) U.S. Cl.

CPC ..... *B25D 9/145* (2013.01); *B25D 9/04* (2013.01); *B25D 9/12* (2013.01); *B25D 9/18* (2013.01); *B25D 9/20* (2013.01); *E02F 3/966* (2013.01); *B25D 2209/005* (2013.01); *B25D 2250/065* (2013.01); *B25D 2250/225* (2013.01); *B25D 2250/231* (2013.01); *B25D 2250/245* (2013.01); *B25D 2250/365* (2013.01); *Y10T 29/4973* (2015.01)

(58) Field of Classification Search

CPC . B25D 9/04; B25D 9/005; B25D 9/14; B25D 9/145; B25D 9/20; B25D 2209/002; B25D 2209/005; B25D 2250/065; B25D 2250/235; B25D 2250/231; B25D 2250/345; B25D 2250/365; E02D 7/06

USPC ..... 173/206, 208

See application file for complete search history.

(56) References Cited

U.S. PATENT DOCUMENTS

| | | | | |
|---|---|---|---|---|
| 3,739,863 | A * | 6/1973 | Wohlwend | B25D 9/145 173/204 |
| 3,754,396 | A | 8/1973 | Erma | |
| 3,827,507 | A * | 8/1974 | Lance | B25D 9/145 173/204 |
| 3,853,036 | A | 12/1974 | Eskridge et al. | |
| 3,991,655 | A | 11/1976 | Bouyoucos et al. | |

(Continued)

FOREIGN PATENT DOCUMENTS

| | | |
|---|---|---|
| CN | 2792723 | 7/2006 |
| CN | 201015863 | 2/2008 |

(Continued)

OTHER PUBLICATIONS

U.S. Patent Application of Cody Moore, entitled "Hydraulic Hammer Having Co-Axial Accumulator and Piston" filed Mar. 15, 2013.

(Continued)

*Primary Examiner* — Nathaniel Chukwurah

(74) *Attorney, Agent, or Firm* — Finnegan, Henderson, Farabow, Garrett & Dunner, LLP

(57) ABSTRACT

An impact system for a hydraulic hammer is disclosed. The impact system may include a piston, a sleeve disposed co-axial with the piston, and an accumulator membrane disposed external to the sleeve. A first seal may be located at an end of the sleeve, and configured to connect the sleeve to the piston. The accumulator membrane may have an extension configured to engage a recess in the sleeve.

13 Claims, 5 Drawing Sheets

(56) References Cited

U.S. PATENT DOCUMENTS

| | | | | | |
|---|---|---|---|---|---|
| 4,005,637 | A * | 2/1977 | Bouyoucos | B25D 9/12 | 91/276 |
| 4,011,795 | A | 3/1977 | Barthe et al. | | |
| 4,018,135 | A * | 4/1977 | Lance | B25D 9/20 | 91/276 |
| 4,077,304 | A * | 3/1978 | Bouyoucos | B25D 9/12 | 91/276 |
| 4,143,585 | A * | 3/1979 | Selsam | B25D 9/12 | 91/276 |
| RE30,109 | E * | 10/1979 | Bouyoucos | B25D 9/12 | 91/276 |
| 4,231,434 | A * | 11/1980 | Justus | B25D 9/145 | 173/204 |
| 4,256,187 | A * | 3/1981 | Barnard | B25D 9/14 | 173/202 |
| 4,261,249 | A | 4/1981 | Grantmyre | | |
| 4,264,107 | A | 4/1981 | Janach et al. | | |
| 4,745,981 | A * | 5/1988 | Buske | B25D 9/145 | 173/202 |
| 5,174,386 | A | 12/1992 | Crover | | |
| 5,222,425 | A * | 6/1993 | Davies | B25D 9/14 | 60/370 |
| 5,944,120 | A | 8/1999 | Barden | | |
| 6,073,706 | A | 6/2000 | Niemi | | |
| 6,105,686 | A | 8/2000 | Niemi | | |
| 6,119,795 | A * | 9/2000 | Lee | B25D 9/00 | 173/114 |
| 7,156,190 | B2 * | 1/2007 | Ottestad | B25D 9/12 | 173/128 |
| 7,328,753 | B2 * | 2/2008 | Henriksson | B25D 9/125 | 173/9 |
| 2003/0006052 | A1 | 1/2003 | Campbell, Jr. | | |
| 2012/0138328 | A1 | 6/2012 | Teipel et al. | | |

FOREIGN PATENT DOCUMENTS

| | | |
|---|---|---|
| CN | 105026111 | 11/2015 |
| DE | 10003415 | 11/2001 |
| EP | 0127885 | 12/1984 |
| EP | 0 933 169 A2 | 1/1999 |
| GB | 1480903 | 4/1973 |
| WO | WO 2004/020155 A1 | 3/2004 |
| WO | 03033504 | 3/2006 |

OTHER PUBLICATIONS

U.S. Patent Application of Cody Moore, entitled "Accumulator Membrane for a Hydraulic Hammer" filed Mar. 15, 2013.

* cited by examiner

HYDRAULIC HAMMER HAVING IMPACT SYSTEM SUBASSEMBLY

TECHNICAL FIELD

The present disclosure is directed to a hydraulic hammer and, more particularly, to a hydraulic hammer having an impact system subassembly.

BACKGROUND

Hydraulic hammers can be attached to various machines such as excavators, backhoes, tool carriers, or other like machines for the purpose of milling stone, concrete, and other construction materials. The hydraulic hammer is mounted to a boom of the machine and connected to a hydraulic system. High pressure fluid is then supplied to the hammer to drive a reciprocating piston and a work tool in contact with the piston. The piston is surrounded and protected by an outer housing. Traditionally, a valve directs fluid within the hammer from an accumulator to the piston. The accumulator provides a reservoir for the fluid.

U.S. Pat. No. 3,853,036 (the '036 patent) that issued to Eskridge et al. on Dec. 10, 1974, discloses an exemplary hydraulic hammer having many individuals components including a piston reciprocally located within an outer housing. An intake fluid reservoir and an outlet fluid reservoir are disposed around a valve at an axial end of the piston, wherein the fluid reservoirs form an accumulator. Each of the individual components is assembled into the outer housing separately.

The many individual components of the '036 patent (e.g. the piston, valve, and fluid reservoirs) may make servicing of the hydraulic hammer difficult. In particular, a user may be required to completely disassemble the hydraulic hammer to repair just one component. This complete disassembly may be expensive and increase a downtime of the associated machine. An increase in downtime can result in lost productivity.

The disclosed system is directed to overcoming one or more of the problems set forth above and/or other problems of the prior art.

SUMMARY

In one aspect, the present disclosure is directed to an impact system for a hydraulic hammer. The impact system may include a piston and a sleeve disposed co-axial with the piston. A first seal may be located at an end of the sleeve and configured to connect the sleeve to the piston. An accumulator membrane may be disposed external to the sleeve and may have an extension configured to engage a recess in the sleeve.

In another aspect, the present disclosure is directed to a method of servicing a hydraulic hammer. The method may include removing a head from a frame, and removing an impact system as a single integral unit from the frame. The impact system may include at least a piston, a sleeve, an accumulator membrane, and a seal carrier. Additionally, the method may include placing a new impact system into the frame, and re-assembling the head to the frame.

DETAILED DESCRIPTION

Figure 1:
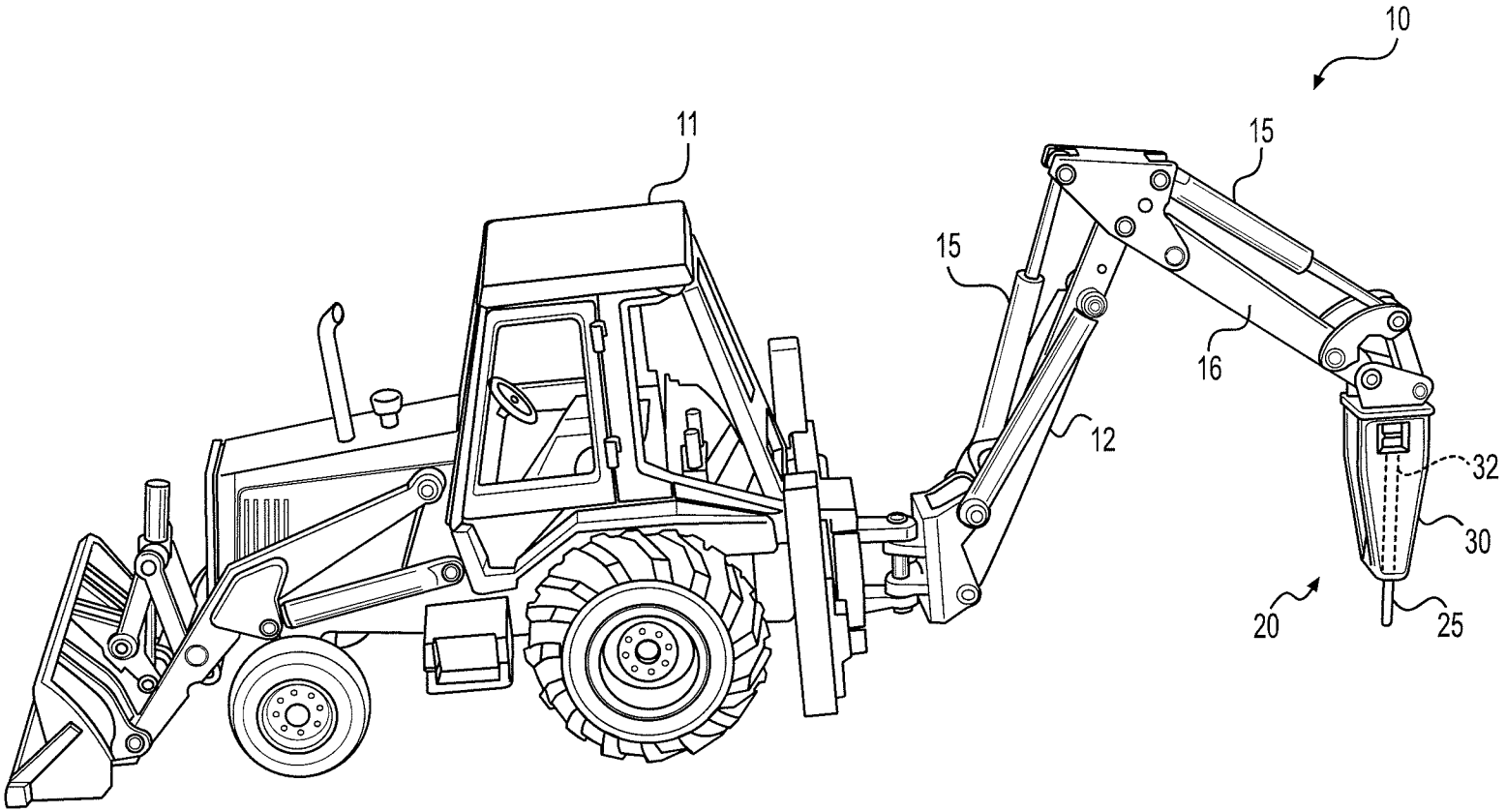
FIG. 1 is a diagrammatic illustration of an exemplary disclosed machine.

FIG. 1 illustrates an exemplary disclosed machine 10 having a hammer 20. Machine 10 may be configured to perform work associated with a particular industry such as, for example, mining or construction. For example, machine 10 may be a backhoe loader (shown in FIG. 1), an excavator, a skid steer loader, or any other machine. Hammer 20 may be pivotally connected to machine 10 through a boom 12 and a stick 16. It is contemplated that another linkage arrangement may alternatively be utilized, if desired.

In the disclosed embodiment, one or more hydraulic cylinders 15 may raise, lower, and/or swing boom 12 and stick 16 to correspondingly raise, lower, and/or swing hammer 20. The hydraulic cylinders 15 may be connected to a hydraulic supply system (not shown) within machine 10. Specifically, machine 10 may include a pump (not shown) connected to hydraulic cylinders 15 and to hammer 20 through one or more hydraulic supply lines (not shown). The hydraulic supply system may introduce pressurized fluid, for example oil, from the pump and into the hydraulic cylinders 15 of hammer 20. Operator controls for movement of hydraulic cylinders 15 and/or hammer 20 may be located within a cabin 11 of machine 10.

As shown in FIG. 1, hammer 20 may include an outer shell 30 and an actuator assembly 32 located within outer shell 30. Outer shell 30 may connect actuator assembly 32 to stick 16 and provide protection for actuator assembly 32. A work tool 25 may be operatively connected to an end of actuator assembly 32 opposite stick 16. It is contemplated that work tool 25 may include any known tool capable of interacting with hammer 20. In one embodiment, work tool 25 includes a chisel bit.

Figure 2:
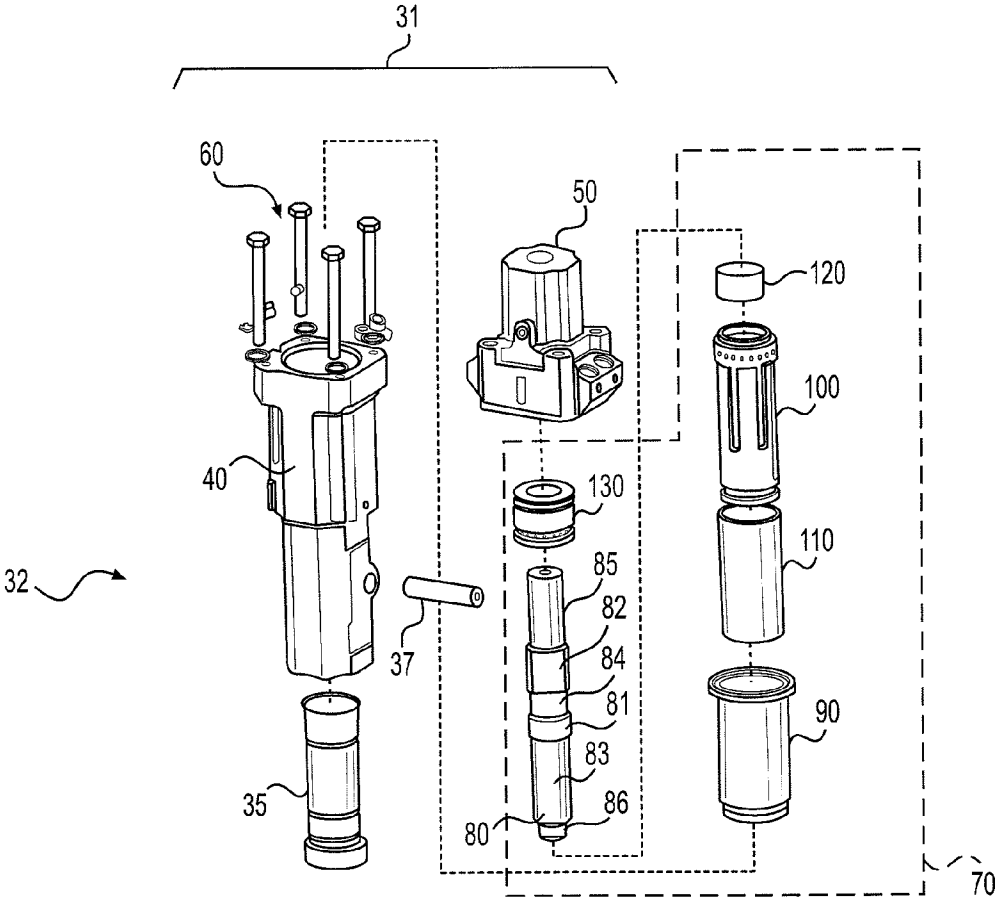
FIG. 2 is an exploded view of an exemplary disclosed hydraulic hammer assembly that may be used with the machine of FIG. 1.

As shown in FIG. 2, actuator assembly 32 may include a subhousing 31, a bushing 35, and an impact system 70. Subhousing 31 may include, among other things, a frame 40 and a head 50. Frame 40 may be a hollow cylindrical body having one or more flanges or steps along its axial length. Head 50 may cap off one end of frame 40. Specifically, one or more flanges on head 50 may couple with one or more flanges on frame 40 to provide a sealing engagement. One or more fastening mechanisms 60 may rigidly attach head 50 to frame 40. In some embodiments, fastening mechanism 60 may include, for example, screws, nuts, bolts, or any other means capable of securing the two components. Frame 40 and head 50 may each include holes to receive fastening mechanism 60.

Bushing 35 may be disposed within a tool end of subhousing 31 and may be configured to connect work tool 25 to impact system 70. A pin 37 may connect bushing 35 to work tool 25. When displaced by hammer 20, work tool 25 may be configured to move a predetermined axial distance within bushing 35.

Impact system 70 may be disposed within an actuator end of subhousing 31 and be configured to move work tool 25 when supplied with pressurized fluid. As shown by the dotted lines in FIG. 2, impact system 70 may be an assembly including a piston 80, an accumulator membrane 90, a sleeve 100, a sleeve liner 110, a valve 120, and a seal carrier 130. Sleeve liner 110 may be assembled within accumulator membrane 90, sleeve 100 may be assembled within sleeve liner 110, and piston 80 may be assembled within sleeve 100. All of these components may be generally co-axial with each other. Valve 120 may be assembled over an end of piston 80 and may be located radially inward of both sleeve 100 and seal carrier 130. A portion of seal carrier 130 may axially overlap with sleeve 100. Additionally, valve 120 may be disposed axially external to accumulator membrane 90. Valve 120 and seal carrier 130 may be located entirely within head 50. Accumulator membrane 90, sleeve 100, and sleeve liner 110 may be located within frame 40. Head 50 may be configured to close off an end of sleeve 100 when connected frame 40. Furthermore, piston 80 may be configured to slide within both frame 40 and head 50 during operation.

Piston 80 may be configured to reciprocate within frame 40 and contact an end of work tool 25. In the disclosed embodiment, piston 80 is a metal cylindrical rod (e.g., a steel rod) approximately 20.0 inches in length. Piston 80 may comprise varying diameters along its length, for example one or more narrow diameter sections disposed axially between wider diameter sections. In the disclosed embodiment, piston 80 includes three narrow diameter sections 83, 84, 85, separated by two wide diameter sections 81, 82. Narrow diameter sections 83, 84, 85 may cooperate with sleeve 100 to selectively open and close fluid pathways within sleeve 100.

Narrow diameter sections 83, 84, 85, may comprise axial lengths sufficient to facilitate fluid communication with accumulator membrane 90. In one embodiment, narrow diameter sections 83, 84, 85 may comprise lengths of approximately 6.3 inches, 2.2 inches, and 5.5 inches, respectively. Additionally, narrow diameter sections 83, 84, 85 may each comprise a diameter suitable to selectively open and close the fluid pathways in sleeve 100, for example diameters of approximately 2.7 inches. Wide diameter sections 81, 82, in one embodiment, may each comprise a diameter of approximately 3.0 inches and configured to slideably engage an inner surface of sleeve 100. However, in other embodiments, any desired dimensions may be used.

Piston 80 may further include an impact end 86 having a smaller diameter than any of narrow diameter sections 83, 84, 85. Impact end 86 may be configured to contact work tool 25 within bushing 35. In one embodiment, impact end 86 may comprise an axial length of approximately 1.5 inches. However, in other embodiments, any desired dimensions may be used.

Figure 3:
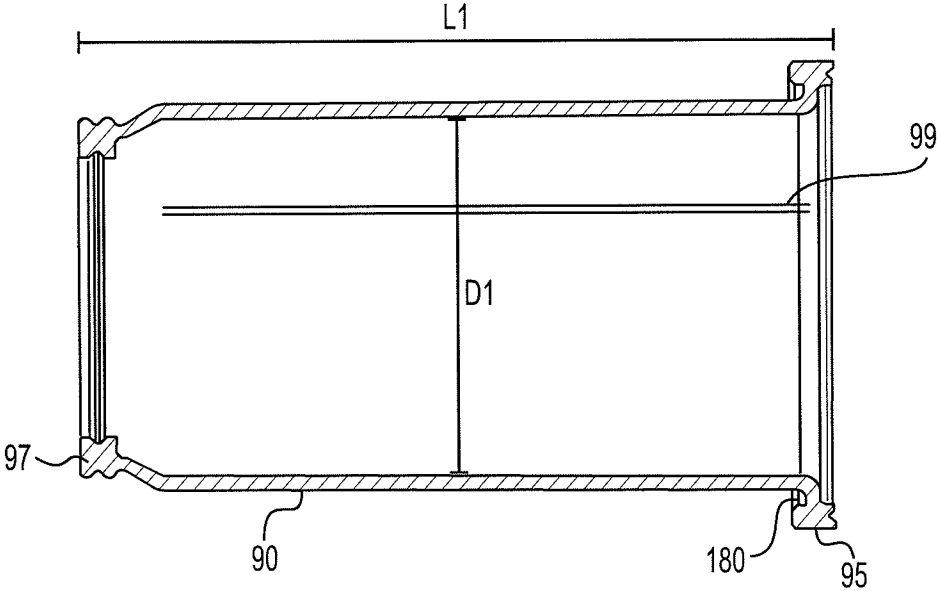
FIG. 3 is a cross-sectional illustration of an exemplary disclosed accumulator membrane that may be used with the hydraulic hammer of FIG. 2.

Accumulator membrane 90 may form a cylindrical tube configured to hold a sufficient amount of pressurized fluid for hammer 20 to drive piston 80 through at least one stroke. In one embodiment, accumulator membrane 90 may extend approximately one-half an axial length of piston 80. As shown in FIG. 3, accumulator membrane 90 may have an axial length L1 of approximately 10.0 inches and an internal diameter D1 of approximately 4.8 inches. Additionally, accumulator membrane 90 may form a volume of 0.3 liters in an annular space 170 between accumulator membrane 90 and sleeve 100. However, in other embodiments, any desired dimensions may be used for accumulator membrane 90. An extension 97 may be formed at one end (i.e. near work tool 25) of accumulator membrane 90. Extension 97 may be disposed co-axial with piston 80 and oriented inwards towards piston 80. A lip 95 may be formed at an opposite end (i.e. near valve 120) of accumulator membrane 90, and may extend backward over a portion of accumulator membrane 90 to create an outer annular pocket 180 or channel. A rib 99 may extend from extension 97 to lip 95, as shown in FIG. 3. Accumulator membrane 90 may be made from a material sufficient for pressurized gas within pocket 180 to selectively compress accumulator membrane 90 inward toward piston 80. In one embodiment, accumulator membrane 90 may comprise an elastic material, for example synthetic rubber. Specifically, the material may comprise a 70 durometer rubber. In other embodiments, accumulator membrane 90 may comprise any suitable material.

Sleeve 100 may form a cylindrical tube having an axial length longer than an axial length of accumulator membrane 90. Sleeve 100 may include a first end 101, located near work tool 25, and a second end 102, located further from work tool 25. A recess 109 may be formed in sleeve 100 at first end 101. In one embodiment, sleeve 100 may have a length of approximately 13 inches. However, in other embodiments, any desired length may be used. One or more fluid passages may be formed within sleeve 100 that extend between piston 80 and accumulator membrane 90. Movement of piston 80 (i.e., of narrow diameter sections 83, 84, 85 and wide diameter sections 81, 82) may selectively open or close these passages. During assembly, sleeve 100 may be configured to slide over a bottom portion of narrow diameter section 83 of piston 80 and sealingly engage wide diameter section 82.

Figure 4:
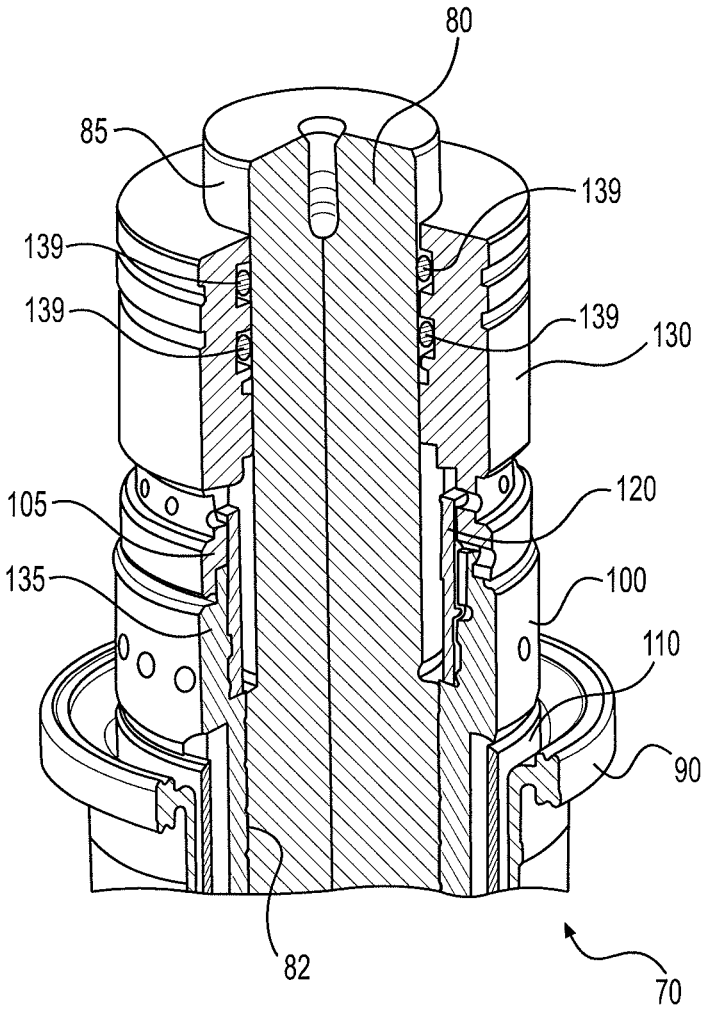
FIGS. 4 and 5 are cross-sectional illustrations of an exemplary impact system that may be used with the hydraulic hammer of FIG. 2.

Valve 120 may include a tubular member located external to and at an axial end of accumulator membrane 90. Valve 120 may be disposed around piston 80 at narrow diameter section 85, and radially inward of sleeve 100, between sleeve 100 and piston 80. As shown in FIG. 4, valve 120 may be located inward of both sleeve 100 and seal carrier 130 such that sleeve 100 surrounds a bottom portion of valve 120 (i.e., a portion closer to lip 95) and seal carrier 130 surrounds a top portion of valve 120 (i.e., a portion opposite lip 95). A cavity 123 may be formed between sleeve 100 and piston 80 and between seal carrier 130 and piston 80. Sleeve 100 and seal carrier 130 may overlap each other to form cavity 123. Valve 120 may be disposed within cavity 123.

As shown in FIG. 4, piston 80, sleeve 100, valve 120, and seal carrier 130 may be held together as a sub-assembly by way of slip-fit radial tolerances. For example, slip-fit radial tolerances may be formed between sleeve 100 and piston 80 and between seal carrier 130 and piston 80. Sleeve 100 may apply an inward radial pressure on piston 80, and seal carrier 130 may apply an inward radial pressure on piston 80. Such may hold sleeve 100, seal carrier 130, and piston 80 together, and may hold valve 120 within cavity 123 (FIG. 4).

Figure 5:
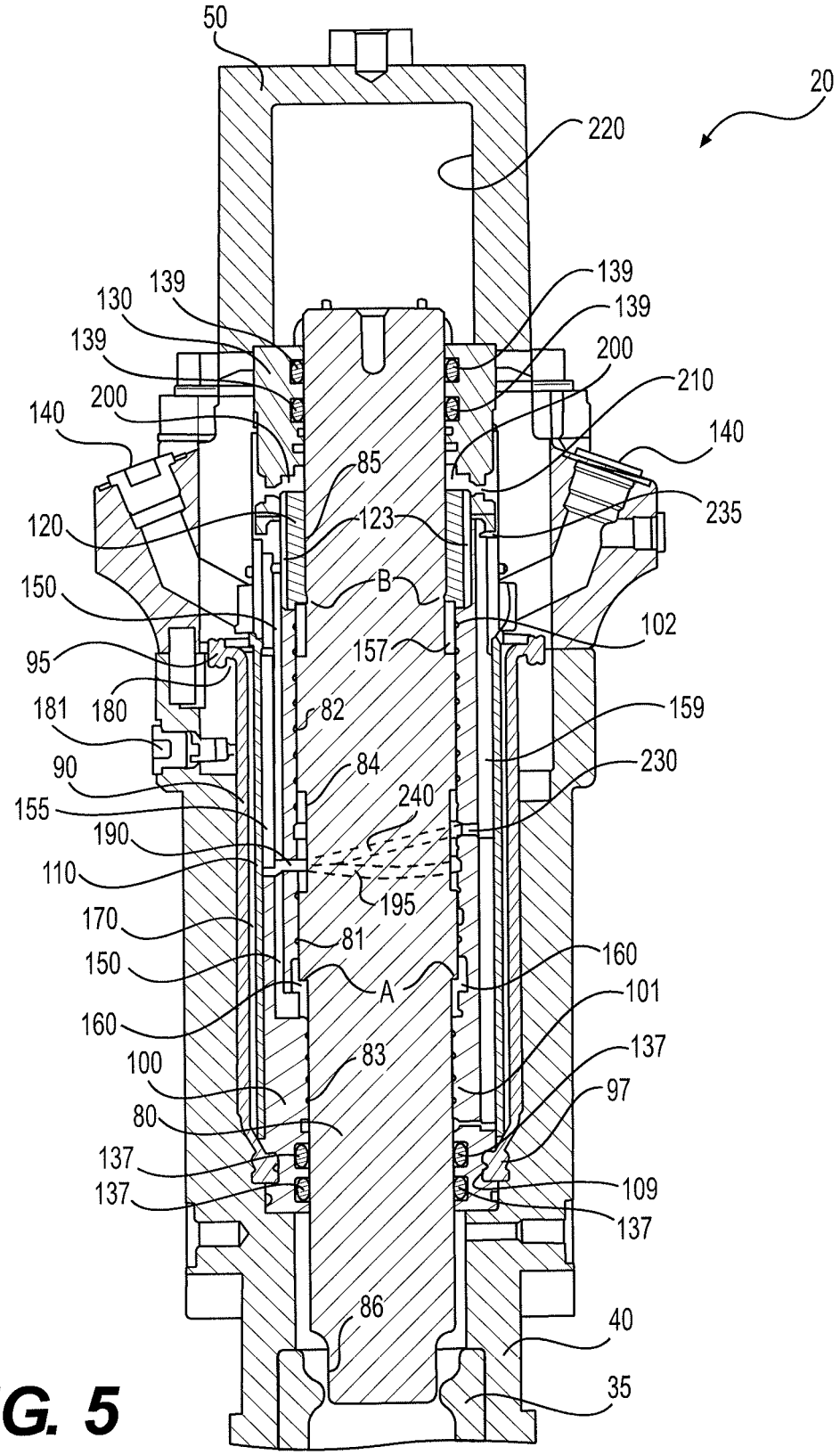

A first seal 137 and a second seal 139 may additionally secure the sub-assembly so that it remains assembled when removed from frame 40. First seal 137 may include one or more U-cup seals or O-rings disposed between sleeve 100 and piston 80. As shown in FIG. 5, first seal 137 may be compressed during assembly to generate a radial force on sleeve 100 and piston 80 after assembly that secures sleeve 100 to piston 80. Second seal 139 may include one or more U-cup seals or O-rings disposed between seal carrier 130 and piston 80. As also shown in FIG. 5, second seal 139 may be compressed during assembly to generate a radial force on seal carrier 130 and piston 80 after assembly that secures seal carrier 130 to piston 80. First and second seals 137, 139 may secure the sub-assembly such that valve 120 is trapped within cavity 123. Valve 120 may be configured to move up and down within cavity 123.

Sleeve 100 and seal carrier 130 may additionally be secured together with a coupling including a slip fit, interference, or any other coupling known in the art. For example, seal carrier 130 may include a female connector 105 received by a male connector 135 on sleeve 100. The female and male connectors 105,135, of the coupling, may secure seal carrier 130 with sleeve 100 and thereby also secure valve 120 against piston 80.

Accumulator membrane 90 may be connected with sleeve 100 through an interference coupling. Specifically, an extension 97 of accumulator membrane 90 may be received within recess 109 of sleeve 100 to couple accumulator membrane 90 with sleeve 100. This connection may further hold impact system 70 together when impact system 70 is removed from frame 40.

As also shown in FIGS. 4 and 5, impact system 70 may include a plurality of longitudinal recesses 150, 155, 157, 159 configured to direct fluid within hammer 20 to move piston 80. First, second, and fourth longitudinal recesses 150, 155, 159, respectively, may be formed as grooves and/or slots within sleeve 100, and third longitudinal recess 157 may be formed as a groove/slot disposed between valve 120 and piston 80. An inlet 140 may be formed within head 50 and extend inward to communicate with the plurality of longitudinal recesses 150, 155, 157, 159. The grooves and/or slots may be of sufficient size for the fluid to flow from inlet 140 down toward bushing 35, within sleeve 100, by a gravitational force.

One or more first longitudinal recesses 150 may fluidly connect inlet 140 with an annular groove 160 formed at an internal surface of sleeve 100. Annular groove 160 may be formed as a concentrically arranged passage around piston 80 With this configuration, fluid may flow from inlet 140, through first longitudinal recesses 150, into annular groove 160, and into contact with a shoulder A at wide diameter section 81 of piston 80.

Inlet 140 may additionally communicate with an annular space 170 that exists between accumulator membrane 90 and sleeve liner 110. Pressurized gas selectively introduced into pocket 180 via gas inlet 181 may apply inward pressure to accumulator membrane 90 and affect the size of annular space 170. That is, as shown in FIG. 5, accumulator membrane 90 may be radially spaced apart from sleeve 100 when accumulator membrane 90 is in a relaxed state (i.e. not under pressure from the gas). For example, accumulator membrane 90 may be spaced approximately 8.0 mm from sleeve 100 when in the relaxed state. Fluid may flow within annular space 170 when accumulator membrane 90 is in the relaxed state. However, when accumulator membrane 90 is under pressure from the pressurized gas, no spacing may exist between accumulator membrane 90 and sleeve 100, and fluid flow therebetween may be inhibited.

A plurality of radial passages 190 may be concentrically formed within an annular wall of sleeve 100 and connect to a first annular ring 195, formed as a concentrically arranged passage around piston 80. First annular ring 195 may fluidly connect radial passages 190 with recesses 150, 155, 157, 159 for movement of fluid to and from recesses 150, 155, 157, 159. Additionally, radial passages 190 may be disposed below valve 120, for example between seal carrier 130 and annular groove 160.

At least one of the first longitudinal recesses 150 may fluidly connect to at least one of the plurality of radial passages 190, such that first longitudinal recesses 150 may fluidly connect radial passages 190 with accumulator membrane 90. This connection may be an indirect connection, around an end of sleeve liner 110. Additionally, first longitudinal recesses 150 may fluidly connect annular groove 160 with accumulator membrane 90 via radial passages 190. Radial passages 190 may be disposed above annular groove 160 such that annular groove 160 is disposed between impact end 86 of piston 80 and radial passages 190.

Each of the plurality of radial passages 190 may further connect first longitudinal recesses 150 to valve 120 via second longitudinal recess 155. As shown in FIG. 5, each of the plurality of radial passages 190 may connect first longitudinal recesses 150 with second longitudinal recess 155. Therefore, when radial passages 190 are open (i.e. upon movement of wide diameter section 81 of piston 80 toward valve 120), fluid may flow from first longitudinal recesses 150, through radial passages 190 and into second longitudinal recess 155. Additionally, fluid within annular groove 160 may flow within first longitudinal recesses 150 toward valve 120, through radial passages 190, and into second longitudinal recess 155. Second longitudinal recess 155 may direct the fluid toward valve 120 and selectively open a fluid chamber 200 via a third longitudinal recess 157.

Fluid chamber 200 may be formed within head 50 and located axially adjacent to a base end of valve 120. Therefore, valve 120 may be located between fluid chamber 200 and radial passages 190. Additionally, fluid chamber 200 may be formed at least partially within seal carrier 130 and co-axial to piston 80. Third longitudinal recess 157 may selectively connect inlet 140 with fluid chamber 200 and be disposed between valve 120 and piston 80.

A plurality of outlet apertures 210 may be formed within seal carrier 130 and fluidly connected with fluid chamber 200. Therefore, outlet apertures 210 may be fluidly connected with radial passages 190 via recesses 150, 157 and fluid chamber 200. Fluid may be selectively released from fluid chamber 200 through outlet apertures 210. As shown in FIG. 5, outlet apertures 210 may be disposed external to accumulator membrane 90, between a gas chamber 220 and lip 95 of accumulator membrane 90.

Movement of narrow diameter section 84 of piston 80 may selectively connect radial passages 190 with an outlet passage 230 via a second annular ring 240. Outlet passage 230 may be disposed external to valve 120. As shown in FIG. 5, second longitudinal recess 155 may be selectively connected to radial passages 190, second annular ring 240, and outlet passage 230 to release fluid within second longitudinal recess 155 from hammer 20. Fourth longitudinal recess 159 may fluidly connect outlet passage 230 with outlet 235. As also shown in FIG. 5, outlet 235 may include one or more apertures formed through sleeve 100 and disposed between fluid chamber 200 and lip 95 of accumulator membrane 90.

FIG. 5 further illustrates gas chamber 220 disposed within head 50 at an end of piston 80 opposite bushing 35. Gas chamber 220 may be located axially adjacent to fluid chamber 200, and may be configured to contain a compressible gas, for example nitrogen gas. Piston 80 may be slideably moveable within gas chamber 220 to increase and decrease the size of gas chamber 220. A decrease in size of gas chamber 220 may increase the gas pressure within gas chamber 220.

INDUSTRIAL APPLICABILITY

The disclosed hydraulic hammer may have an impact system that can be assembled and removed from the hammer as a single integral unit. The impact system, being an integral subassembly, may not require placement of individual components and fastening during assembly. Instead, the subassembly as a whole may be a drop-in replacement assembly, which can help reduce service and downtime of the machine. Assembly of the impact system and servicing of machine 10 will now be described in detail.

Assembly of impact system 70, as shown in FIGS. 4 and 5, may include sliding sleeve 100 over a bottom portion of narrow diameter section 83, and arranging sleeve 100 external and co-axial to piston 80. First seal 137 may be compressed during this assembly, and thereby secure sleeve 100 to piston 80. The assembly may further include sliding accumulator membrane 90 over first end 101 of sleeve 100 and engaging extension 97 with recess 109. Specifically, extension 97 may be snapped within recess 109 and thereby hold accumulator membrane 90 and sleeve 100 together. Accumulator membrane 90 may be arranged external and co-axial to sleeve 100. Additionally, seal carrier 130 may be slid over narrow diameter section 85 and arranged external and co-axial to piston 80. Second seal 139 may be compressed during this assembly, and thereby secure seal carrier 130 to piston 80. Accordingly, impact system 70 may be held together as a single integral unit by compression of seals 137, 139 and by engagement of extension 97 with recess 109.

The arrangement of piston 80, sleeve 100, and seal carrier 130 may form cavity 123. Valve 120 may be trapped within cavity 123. Additionally, the arrangement of sleeve 100 and accumulator membrane 90 may trap sleeve liner 110 between sleeve 100 and accumulator membrane 90.

Impact system 70 may be removed from hammer 20 as one integral unit to facilitate faster service and low downtime of machine 10. For example, upon failure of first seal 137, instead of breaking down hammer 20 piece-by-piece until first seal 137 is exposed, impact system 70 may be removed as one integral unit to repair first seal 137. Specifically, hammer 20 may be removed from a linkage of machine 10, and actuator assembly 32 may be removed from outer shell 30. Therefore, head 50, frame 40, and impact system 70 may be removed from outer shell 30. Head 50 may then be removed from frame 40 to expose impact system 70. Hammer 20 may be removed from the linkage before head 50 is removed from frame 40. A user may remove impact system 70, from frame 40, as a single integral unit and place a new impact system 70 into frame 40. Head 50 may be reassembled with frame 40, and then actuator assembly 32 may be re-installed into outer shell 30. Hammer 20 may be re-assembled to the linkage of machine 10 after head 50 has been re-assembled to frame 40.

The failed component, for example, first seal 137, may be serviced in a shop at a later time, after impact system 70 has been removed from frame 40 and the new impact system 70 placed into frame 40. Therefore, first seal 137 may be serviced at a slower pace without affecting the downtime of machine 10. Additionally or alternatively, servicing a failed component may include servicing of one or more seals 137,139, valve 120, or sleeve liner 110.

The present disclosure may provide a hydraulic hammer having an impact system formed as a sub-assembly that may be removed from the hammer as one integral unit. Therefore, a user may remove the impact system from the hammer when repairing a component of the impact system instead of dissembling the entire hammer. This may reduce cost and time to repair the hammer and may reduce downtime of the machine associated with the hammer.

It will be apparent to those skilled in the art that various modifications and variations can be made to the system of the present disclosure. Other embodiments of the system will be apparent to those skilled in the art from consideration of the specification and practice of the method and system disclosed herein. It is intended that the specification and examples be considered as exemplary only, with a true scope of the disclosure being indicated by the following claims and their equivalents.

What is claimed is:

1. An impact system for a hydraulic hammer, the impact system comprising:

a piston;

a sleeve disposed co-axial with the piston;

a first seal located at an end of the sleeve and configured to connect the sleeve to the piston;

an accumulator membrane disposed external to the sleeve and having an extension configured to engage a recess in the sleeve;

a seal carrier disposed co-axial with the piston, wherein a cavity is formed between the sleeve and the piston, and between the seal carrier and the piston;

a valve trapped within the cavity such that the sleeve surrounds a bottom portion of the valve and the seal carrier surrounds a top portion of the valve; and a sleeve liner assembled within the accumulator membrane, the sleeve being assembled within the sleeve liner, and the piston being assembled within the sleeve, all of the sleeve liner, the sleeve, the accumulator membrane, and the piston, being generally co-axial with each other such that the impact system is removable from the hydraulic hammer as an integral unit.

2. The impact system of claim 1, wherein the first seal is configured to generate a radial force on the sleeve and the piston after assembly that secures the sleeve to the piston.

3. The impact system of claim 1, wherein the extension is co-axial with the piston and oriented inwards towards the piston.

4. The impact system of claim 1, further including a second seal configured to connect the seal carrier to the piston.

5. The impact system of claim 4, wherein the second seal is configured to generate a radial force on the seal carrier and the piston after assembly that secures the seal carrier to the piston.

6. The impact system of claim 1, wherein the valve is disposed external to the accumulator membrane.

7. The impact system of claim 1, wherein the seal carrier and the sleeve overlap each other axially to form the cavity.

8. The impact system of claim 1, wherein:

the seal carrier includes a female connector; and the sleeve includes a male connector received by the female connector.

9. The impact system of claim 1, wherein the sleeve liner is trapped between the sleeve and accumulator membrane.

10. The impact system of claim 1, wherein the accumulator membrane extends one-half an axial length of the piston.

11. An impact system for a hydraulic hammer, the impact system comprising:

a piston;

a sleeve disposed external to the piston by way of slip-fit radial tolerances;

a first seal located at a first end of the sleeve and configured to connect the sleeve to the piston;

an accumulator membrane disposed external to the sleeve and having an extension configured to engage a recess in the sleeve;

a seal carrier disposed external to the piston by way of slip-fit radial tolerances, wherein a cavity is formed between the sleeve and the piston, and between the seal carrier and the piston;

a valve trapped within the cavity such that the sleeve surrounds a bottom portion of the valve and the seal carrier surrounds a top portion of the valve;

a second seal located at a second end of the sleeve and configured to connect the seal carrier to the piston; and a sleeve liner assembled within the accumulator membrane, the sleeve being assembled within the sleeve liner, and the piston being assembled within the sleeve, all of the sleeve liner, the sleeve, the accumulator membrane, and the piston, being generally co-axial with each other such that the impact system is removable from the hydraulic hammer as an integral unit.

12. The impact system of claim 11, wherein the seal carrier and the sleeve overlap each other axially to form the cavity.

13. The impact system of claim 11, wherein:

the first seal generates a force on the sleeve and the piston that secures the sleeve to the piston; and the second seal generates a force on the seal carrier and the piston that secures the seal carrier to the piston.

* * * * *